United States Patent [19]

Cline et al.

[11] Patent Number: 4,723,080

[45] Date of Patent: Feb. 2, 1988

[54] TOUCH CONTROL FOR INCANDESCENT LAMP

[75] Inventors: Ronald A. Cline, Williamsport; Thomas E. Gouldy, South Williamsport, both of Pa.

[73] Assignee: GTE Products Corporation, Stamford, Conn.

[21] Appl. No.: 774,848

[22] Filed: Sep. 11, 1985

[51] Int. Cl.[4] ..... H01H 35/00

[52] U.S. Cl. ..... 307/116; 340/825.69

[58] Field of Search ..... 340/825.69, 825.72; 367/197; 307/116, 126, 139

[56] References Cited

U.S. PATENT DOCUMENTS

| | | | |
|---|---|---|---|
| 3,440,347 | 4/1969 | Spencer et al. | 367/197 |
| 3,445,848 | 5/1969 | Goldstein | 340/825.72 X |
| 4,315,248 | 2/1982 | Ward | 340/825.72 |
| 4,365,238 | 12/1982 | Kollin | 367/197 |
| 4,390,877 | 6/1983 | Curran | 340/825.72 |

*Primary Examiner*—William M. Shoop, Jr.
*Assistant Examiner*—Sharon D. Logan
*Attorney, Agent, or Firm*—William H. McNeill

[57] ABSTRACT

A conversion unit for a light source includes a housing which includes circuit means for turning the lamp on and off as well as providing several brightness levels of illumination. The housing includes a male plug for connection to a power source; a female receptacle for receiving a lamp plug; an antenna receptor; and an antenna connected to the receptor and terminating in an electrically conductive member. The last named member becomes the switch for the lamp when the unit is in operation.

3 Claims, 2 Drawing Figures

TOUCH CONTROL FOR INCANDESCENT LAMP

TECHNICAL FIELD

The invention relates to touch control conversion units for incandescent lamps and more particularly to such a conversion unit which can convert any lamp, regardless of the material from which the lamp is made, into a lamp which can be turned on, and have its brightness level controlled, merely by touch.

BACKGROUND ART

Recent developments in integrated circuits have provided a means of controlling the on-off feature of incandescent lamps as well as providing various brightness levels. In the past, if a consumer desired these features, it was necessary to purchase a new, custom made lamp employing these features or to engage in an extensive re-wiring of a favorite lamp to include the desired circuitry. Since the lamps made with this feature included are available in only a limited number of styles, all of which have a metallic construction, it is not always possible for a consumer to find a lamp of suitable decor.

The re-wiring of a favorite lamp is beyond the ken of many consumers who also may be reluctant to take apart a favorite and expensive lamp.

DISCLOSURE OF THE INVENTION

It is, therefore, an object of this invention to obviate the disadvantages of the prior art.

It is another object of the invention to enhance touch control lamps.

Yet another object of the invention is the provision of a conversion unit for lamps which allows the incorporation into any lamp of the features of touch control for on-off functions as well as brightness control which entails no re-wiring of the existing lamp.

These objects are accomplished, in one aspect of the invention, by the provision of a conversion unit which includes a housing containing a circuit means mounted therewithin for controlling the light source. Male plug means are provided on the housing for engaging a source of electrical power. The male plug means are electrically connected to the circuit means. A female receptacle means contiguous with the housing is also provided and, likewise, is connected to the circuit means. The housing also proivdes an antenna receptor which is connected to the circuit means. An electrically conductive antenna completes the unit, the antenna having a first end engageable with the receptor and a second end terminating in an electrically conductive member.

This unit accomplishes the objects of the invention in a simple and expedient manner. To convert a lamp to touch control, the male plug means of the housing is connected to a source of power; e.g., by plugging it into a typical household wall socket. The male lamp plug is inserted into the female receptacle on the housing and the antenna connected to the antenna receptor. The second end of the antenna thus becomes the touchable switch for the lamp and can be placed adjacent to the lamp or at a point remote therefrom. The unit will work with any lamp of any construction and no re-wiring of the lamp is necessary, thus making the unit available for use by people with no wiring experience.

BEST MODE FOR CARRYING OUT THE INVENTION

Figure 1:
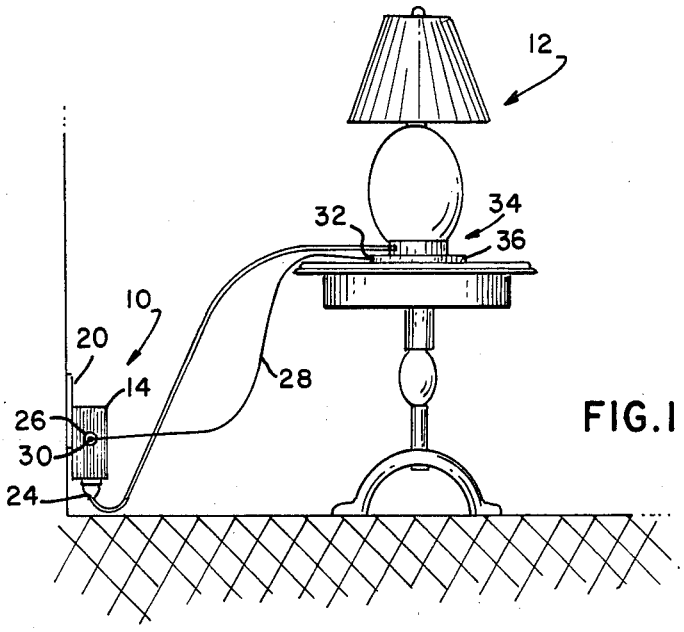
FIG. 1 is a diagrammatic view of the conversion unit in a working environment.
Figure 2:
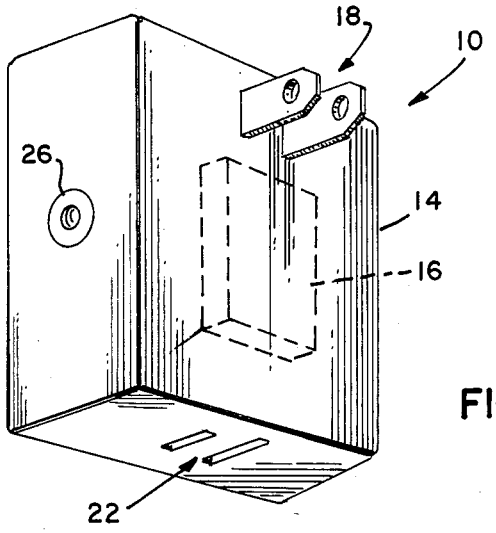
FIG. 2 is an enlarged, perspective view of the housing of the conversion unit.

For a better understanding of the present invention, together with other and further objects, advantages and capabilities thereof, reference is made to the following disclosure and appended claims taken in conjunction with the above-described drawings.

Referring now to the drawings with greater particularity, there is shown a conversion unit 10 for a light source 12, for example, an incandescent table lamp. The conversion unit 10 includes a housing 14 of a suitable electrically insulating material such as plastic and circuit means 16 mounted within the housing 14. The circuit means 16 can be in the form of an integrated circuit chip, the exact configuration of which forms no part of this invention. Suitable circuits for use with this invention are known and are shown, for example, in U.S. Pat. Nos. 3,715,623 and 4,163,923. Additional circuitry is available from LSI Computer Systems, Inc. of Melville, N.Y., under part nos. LS7231-L7235.

The housing 14 includes male plug means 18, preferably polarized, contiguous with the housing 14, for engaging a source of eletrical power, such as 120 V AC, via wall outlet 20. Internally of housing 14 the male plug means 18 is connected to the circuit means 16.

Female receptacle means 22, also polarized, additionally is provided in housing 14 for the reception of a male plug 24 from the light source 12. Means 22 also is connected internally of housing 14 to circuit means 16.

An antenna receptor 26 is provided on housing 14 and is connected to circuit means 16. An antenna 28 has a first end 30 which is engageable with the antenna receptor 26 and a second end 32 which terminates in an electrically conductive member 34, which can be a metallic pad 36.

In a preferred form, antenna 28 comprises a memoryless cable and the second end 32 is disconnectable from member 34.

Also, for safety reasons, it is perferred that the connecting members on both the first end 30 and second end 32 of antenna 28 be of a size sufficiently large so that they may not inadvertently be inserted into either of the openings of female receptacle 22 or wall outlet 20.

There is thus provided a light source conversion unit that is simple and economical to use and that requires no re-wiring of a lamp. The unit will work with any incandescent lamp, regardless of construction, thereby greatly enhancing decor options.

While there have been shown and described what are at present considered to be the preferred forms of the invention, it will be apparent to those skilled in the art that various changes and modifications can be made herein without departing form the scope of the invention as defined by the appended claims.

What is claimed is:

1. A touch control conversion unit for a light source, said touch control conversion unit comprising: a housing; circuit means mounted within said housing for controlling said light source; male plug means contiguous with said housing for engaging a source of electrical power, said male plug means being electrically connected to said circuit means; female receptable means for receiving a male plug connected to said light source, said female receptacle means being contiguous with said housing and being electrically connected to said circuit means and comprising at least two openings of a given size; an antenna receptor on said housing, said antenna receptor being electrically connected to said circuit means; and an electrically conductive antenna having a first end engageable with said antenna receptor and a second end terminating in an electrically conductive member which forms a touchable switch for actuating said light source in response to touch,

2. The conversion unit of claim 1 wherein said second end of said antenna is disconnectable from said electrically conductive member.

3. The conversion unit of claim 1 wherein said antenna comprises a memoryless cable.

* * * * *